US009666956B2

(12) United States Patent
Takahashi

(10) Patent No.: US 9,666,956 B2
(45) Date of Patent: May 30, 2017

(54) MINUTE CURRENT CRIMPING TERMINAL AND MINUTE CURRENT WIRE HARNESS

(71) Applicant: YAZAKI CORPORATION, Minato-ku, Tokyo (JP)

(72) Inventor: Takakazu Takahashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/715,642

(22) Filed: May 19, 2015

(65) Prior Publication Data

US 2015/0333415 A1 Nov. 19, 2015

(30) Foreign Application Priority Data

May 19, 2014 (JP) ..... 2014-103566
May 19, 2014 (JP) ..... 2014-103639

(51) Int. Cl.

| | |
|---|---|
| ***H01R 4/20*** | (2006.01) |
| ***H01R 4/18*** | (2006.01) |
| ***H01B 7/28*** | (2006.01) |
| ***H01R 43/00*** | (2006.01) |
| ***H01R 4/26*** | (2006.01) |

(Continued)

(52) U.S. Cl.

CPC ..... *H01R 4/184* (2013.01); *H01B 7/2806* (2013.01); *H01R 4/185* (2013.01); *H01R 4/26* (2013.01); *H01R 4/62* (2013.01); *H01R 13/03* (2013.01); *H01R 43/00* (2013.01); *H01R 4/188* (2013.01); *H01R 13/11* (2013.01); *Y10T 29/4921* (2015.01)

(58) Field of Classification Search

CPC ..... H01R 4/20
USPC ..... 174/84 C; 439/877
See application file for complete search history.

(56) References Cited

U.S. PATENT DOCUMENTS 3,020,333 A * 2/1962 Bangert ..... H01R 4/16 174/84 R
3,895,851 A * 7/1975 Bolton ..... H01R 4/62 174/84 C (Continued)

FOREIGN PATENT DOCUMENTS

CN 1184344 A 6/1998
CN 102273018 A 12/2011

(Continued)

OTHER PUBLICATIONS

The Office Action issued on Jan. 3, 2017 in a counterpart Chinese patent application.

*Primary Examiner* — Chau N Nguyen
(74) *Attorney, Agent, or Firm* — Mots Law, PLLC

(57) ABSTRACT

A minute current crimping terminal (1) includes a wire barrel portion (37) connected to a core wire including any one of aluminum and aluminum alloy, a current flowing through the core wire being lower than a normal current. The wire barrel portion (37) includes a base material (31) including any one of iron and iron alloy with corrosion resistance, at least a first layer (33) provided on a surface of a part of the base material (31) configuring the wire barrel portion (37), and at least a second layer (35) provided on a surface of the first layer (33), wherein the first layer (33) includes a material to remove a passive film present on a surface of the base material (31), and the second layer (35) includes a material capable of increasing corrosion resistance and lubricity, and stabilizing a value of electrical resistance.

20 Claims, 9 Drawing Sheets

(51) Int. Cl.

| | |
|---|---|
| ***H01R 4/62*** | (2006.01) |
| ***H01R 13/03*** | (2006.01) |
| *H01R 13/11* | (2006.01) |

(56) References Cited

U.S. PATENT DOCUMENTS

| | | | | |
|---|---|---|---|---|
| 6,942,529 | B2 * | 9/2005 | Fujimoto | H01R 13/03 439/886 |
| 8,915,761 | B2 * | 12/2014 | Kakuta | H01R 13/03 428/647 |
| RE45,924 | E * | 3/2016 | Oda | C25D 5/12 |
| 2001/0008709 | A1 | 7/2001 | Asakura et al. | |
| 2010/0108358 | A1 * | 5/2010 | Harazono | H01G 9/008 174/126.2 |
| 2010/0163276 | A1 * | 7/2010 | Yamaguchi | H01H 1/021 174/126.2 |
| 2010/0218975 | A1 * | 9/2010 | Mehan | H01B 7/0225 174/120 SR |
| 2011/0151729 | A1 * | 6/2011 | Nishide | H01R 4/185 439/877 |
| 2011/0294368 | A1 | 12/2011 | Nakata et al. | |
| 2014/0011411 | A1 | 1/2014 | Matsushita | |

FOREIGN PATENT DOCUMENTS

| | | | |
|---|---|---|---|
| CN | 103493295 | A | 1/2014 |
| JP | 2013-243106 | A | 12/2013 |
| WO | WO 2007-034921 | * | 3/2007 |
| WO | 2013/161551 | A1 | 10/2013 |

* cited by examiner

MINUTE CURRENT CRIMPING TERMINAL AND MINUTE CURRENT WIRE HARNESS

CROSS REFERENCE TO RELATED APPLICATIONS

This application claims the priority of Japanese Patent Application No. 2014-103639, filed on May 19, 2014, and Japanese Patent Application No. 2014-103566, filed on May 19, 2014, the entire content of which are incorporated herein by reference.

BACKGROUND

Technical Field

The present invention relates to a minute current crimping terminal and a minute current wire harness.

Related Art

Conventionally, a crimping terminal (copper crimping terminal) including a base material containing copper or copper alloy has been known. When a core wire including aluminum or aluminum alloy is connected to this crimping terminal, elution of aluminum is promoted, and corrosion of the core wire and the crimping terminal progresses rapidly, due to the potential difference between the aluminum included in the core wire and the copper included in the base material.

Therefore, conventionally, a crimping terminal (copper crimping terminal) having the configuration that a plating layer of tin is provided on the surface of the base material including copper or copper alloy has been known.

In addition, conventionally, a wire with terminals 301 as shown in FIG. 10 has been known (refer to JP 2013-243106 A).

The wire with terminals 301 is configured to include a wire 307 covering a core wire 303 containing aluminum or aluminum alloy with an insulating coating 305; and a terminal 313 including a barrel portion 309 crimped to the core wire 303 exposed from the terminal of a wire 307, and a connecting portion 311 conductively connected to the mating terminal.

The terminal 313 includes a terminal body 315 containing iron or iron alloy, and a conductive member 317. The conductive member 317 is arranged at least between the barrel portion 309 and the core wire 303, and between the connecting portion 311 and the mating terminal. Then, the conductive member 317 includes a metal material having the ionization tendency equivalent to the core wire 303 or closer to the core wire 303 than to the terminal body 315, and having less electrical resistance than the terminal body 315.

SUMMARY

By the way, a copper crimping terminal has the features of excellent strength, easy bending and high conductivity. However, a copper crimping terminal has a problem of having the possibility that corrosion of the core wire and crimping terminals progresses rapidly by many years of use of the vehicle (vehicle where a copper crimping terminal is used) under severe use environment such as exposure to the sea breeze, and high temperature and high humidity, even when tin plating is provided on the surface.

In a copper crimping terminal to which a core wire including aluminum or the like is connected, for example, when the moisture including salt infiltrates into the contact portion between the tin-plated layer and the base material such as copper (contact portion of the dissimilar metals), tin is eluted by a potential difference between tin and copper. In a copper crimping terminal, when the copper base material is exposed by the elution of tin progressing, the core wire and the copper base material come into contact.

As a result, in a copper crimping terminal to which a core wire including aluminum or the like is connected, the elution of aluminum and the elution of tin are promoted by the potential difference between aluminum included in the core wire and copper included in the base material, and corrosion of the core wire and the crimping terminal progresses rapidly.

In addition, if a normal current flows through the copper crimping terminal where corrosion has occurred in this way and the terminal is used, there is a possibility that the terminal generates heat and that the electrical resistance value rises.

Wire with terminals 301 shown in FIG. 10 is hard to corrode and has a reduced electric resistance by including the conductive member 317, however, has a more complicated configuration by the presence of the conductive member 317.

The present invention is made by paying attention to the above problems and the like, and has an object to provide a minute current crimping terminal and a minute current wire harness that have simple configurations, are hard to corrode even by many years of use, and make it possible to reduce the temperature increase and the increase in electrical resistance due to the temperature increase by a minute current flowing therethrough, even when the base material contains stainless steel having larger electric resistance value as compared to copper.

According to one aspect of the present invention, a minute current crimping terminal includes a wire barrel portion connected to a core wire including any one of aluminum and aluminum alloy, a current flowing through the core wire being lower than a normal current. The wire barrel portion includes a base material including any one of iron and iron alloy with corrosion resistance, at least a first layer provided on a surface of a part of the base material configuring the wire barrel portion, and at least a second layer provided on a surface of the first layer. The first layer includes a material to remove a passive film present on a surface of the base material, and the second layer includes a material capable of increasing corrosion resistance and lubricity, and stabilizing a value of electrical resistance.

The first layer may include nickel, and the second layer may include any one of tin, silver, and gold.

The core wire connected to the wire barrel portion may have a cross section of 0.13 square millimeters to 0.5 square millimeters, and a value of the current flowing through the core wire connected to the wire barrel portion may be 3.5 ampere or less.

According to another aspect of the present invention, a method for manufacturing a minute current crimping terminal, the minute current crimping terminal having a wire barrel portion connected to a core wire including any one of aluminum and aluminum alloy, a current flowing through the core wire being lower than a normal current. The method includes a first layer installation step providing a first layer including a material to remove a passive film present on a surface of a base material, on a surface of the base material of the wire barrel portion including any one of iron and iron alloy with corrosion resistance, a second layer installation step providing a second layer including a material capable of increasing corrosion resistance and lubricity, and stabilizing a value of electrical resistance on a surface of the first layer provided in the first layer installation step, and a forming step forming the base material on which the first layer and the second layer are provided in the first layer installation step and the second layer installation step.

According to still another aspect of the present invention, a minute current wire harness includes the aforementioned minute current crimping terminal, and a wire including the core wire connected to the wire barrel portion.

The minute current wire harness may be used in a minute current circuit.

According to the present invention, it is possible to provide a minute current crimping terminal and a minute current wire harness that have simple configurations, are hard to corrode even by many years of use, and are possible to reduce the temperature increase and the increase in electrical resistance due to the temperature increase by a minute current flowing therethrough, even when the base material contains stainless steel having larger electric resistance value as compared to copper.

DETAILED DESCRIPTION

First Embodiment

Figure 3:
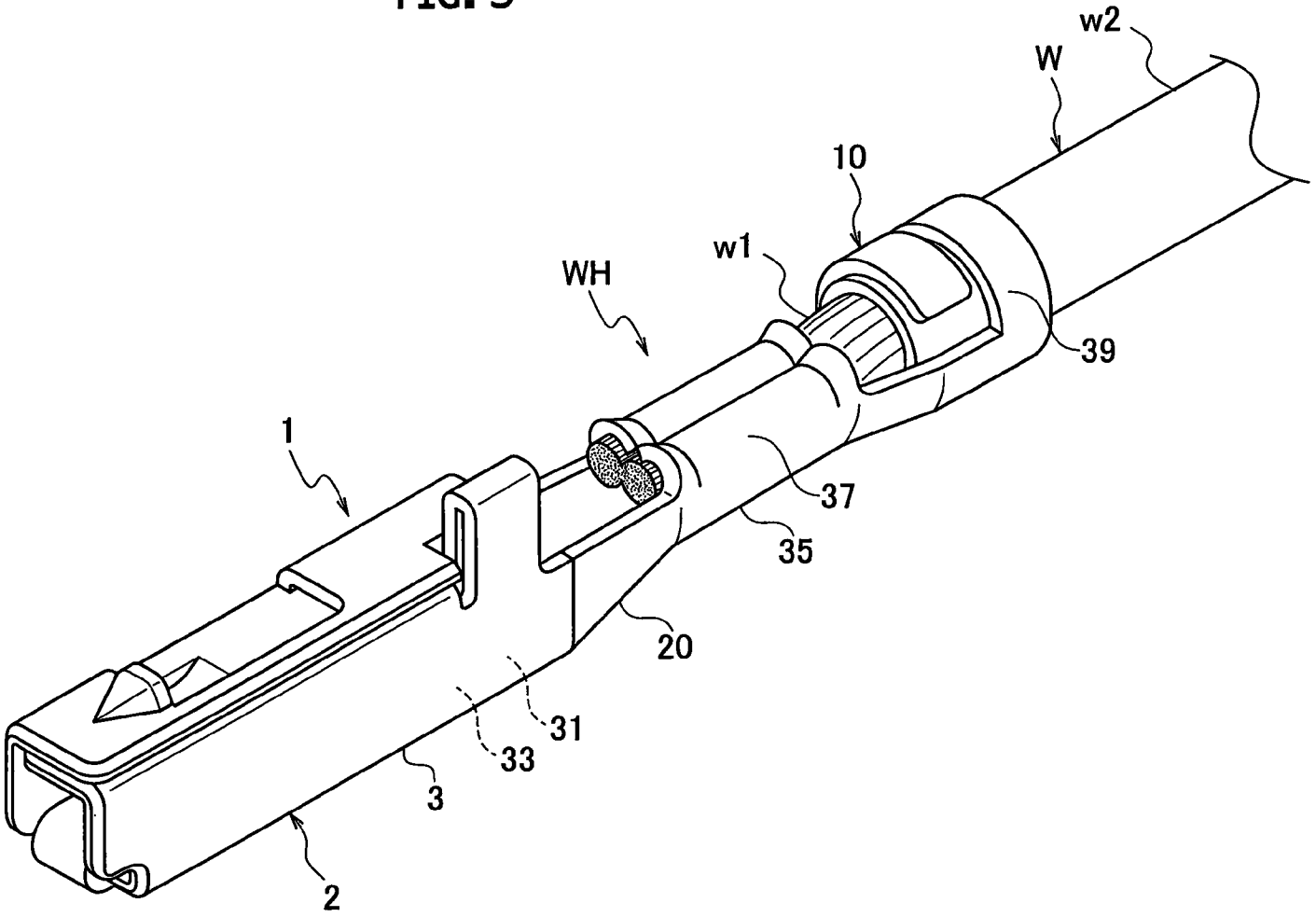
FIG. 3 is a perspective view of a wire harness with the minute current crimping terminal according to the first embodiment of the present invention.
Figure 4:
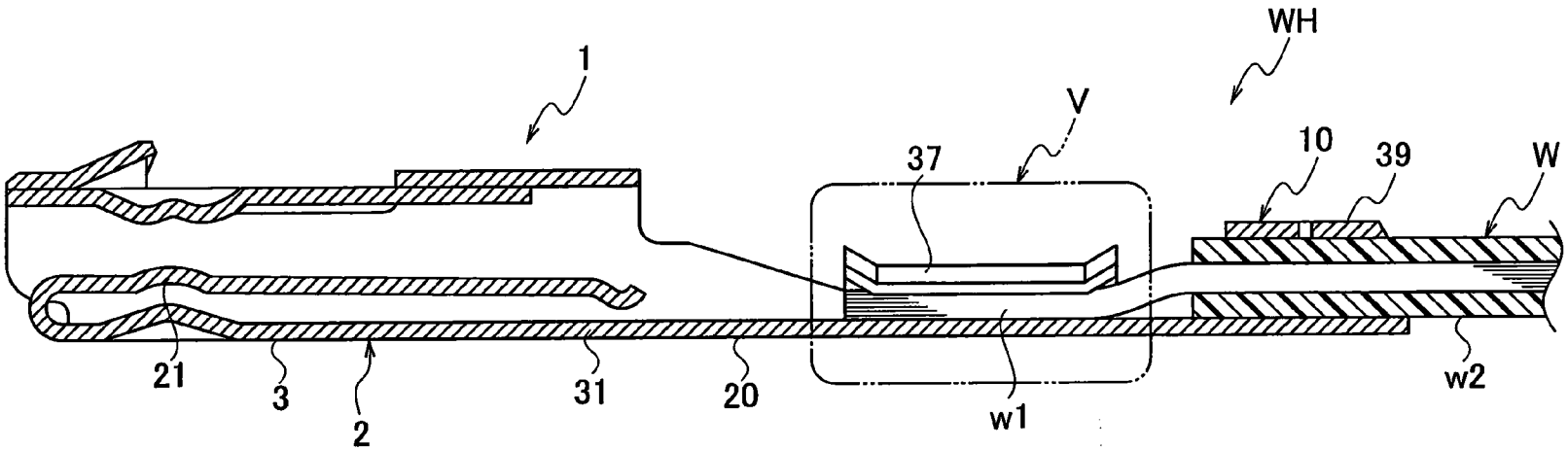
FIG. 4 is a cross-sectional view of the wire harness with the minute current crimping terminal according to the first embodiment of the present invention.

A minute current crimping terminal 1 according to a first embodiment is, as shown in FIGS. 3 and 4, is connected to wire (for example, minute current wire) W to be used, and a core wire (conductor) w1 of the wire W includes, for example, aluminum or aluminum alloy. In addition, the current flowing through the core wire w1 and the minute current crimping terminal 1 connected to the core wire w1 is lower than a normal current. The wire W where minute current crimping terminal (crimping terminal for electrical signal transmission) 1 is installed (connected) becomes minute current wire harness (for example, wire harness for transmitting a signal in a vehicle) WH. The minute current wire harness WH is, for example, connected to a minute current circuit to be used.

Figure 1:
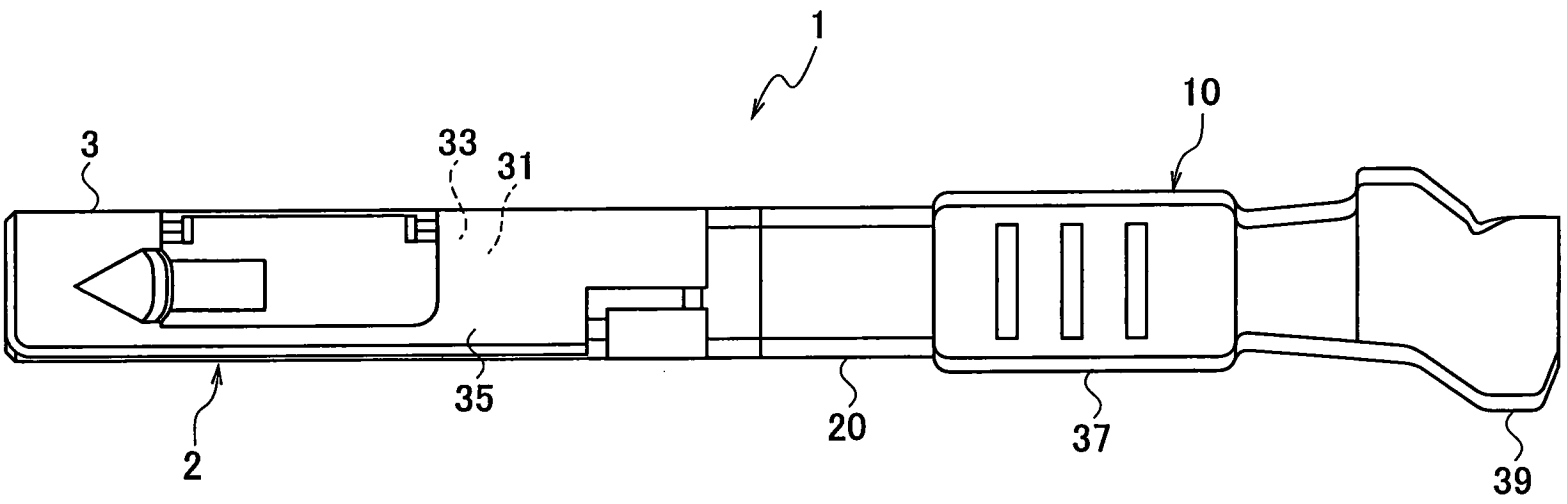
FIG. 1 is a plan view of a minute current crimping terminal according to a first embodiment of the present invention.
Figure 2:
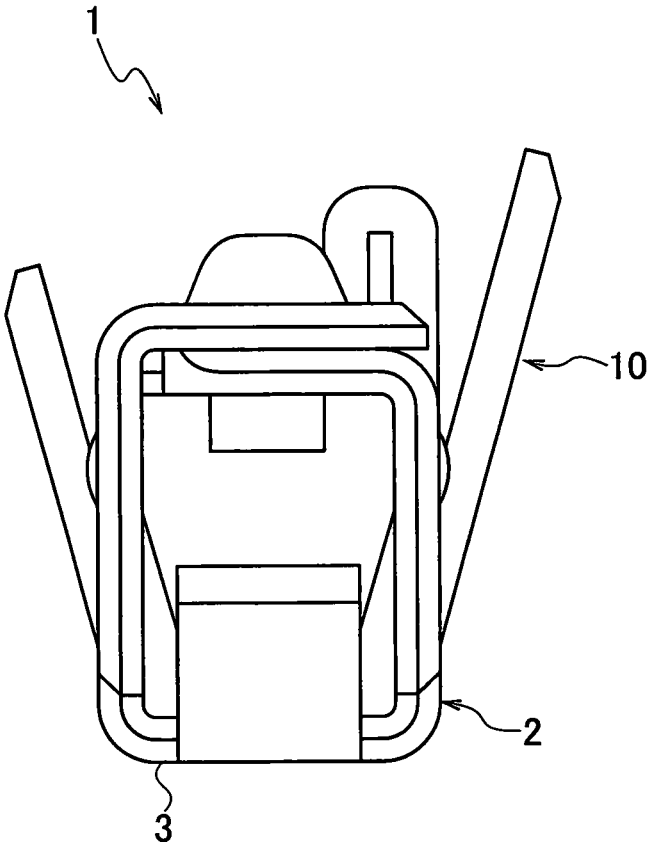
FIG. 2 is a front view of the minute current crimping terminal according to the first embodiment of the present invention.
Figure 5:
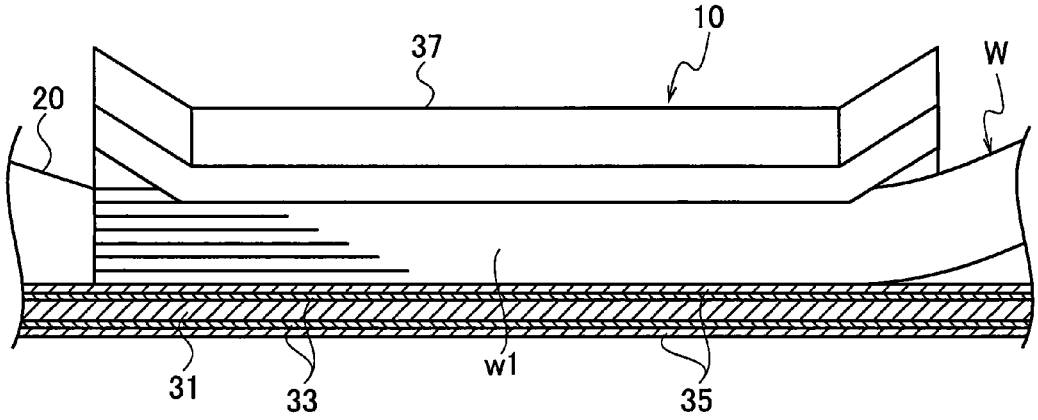
FIG. 5 is an enlarged view of V portion in FIG. 4.
Figure 6A:
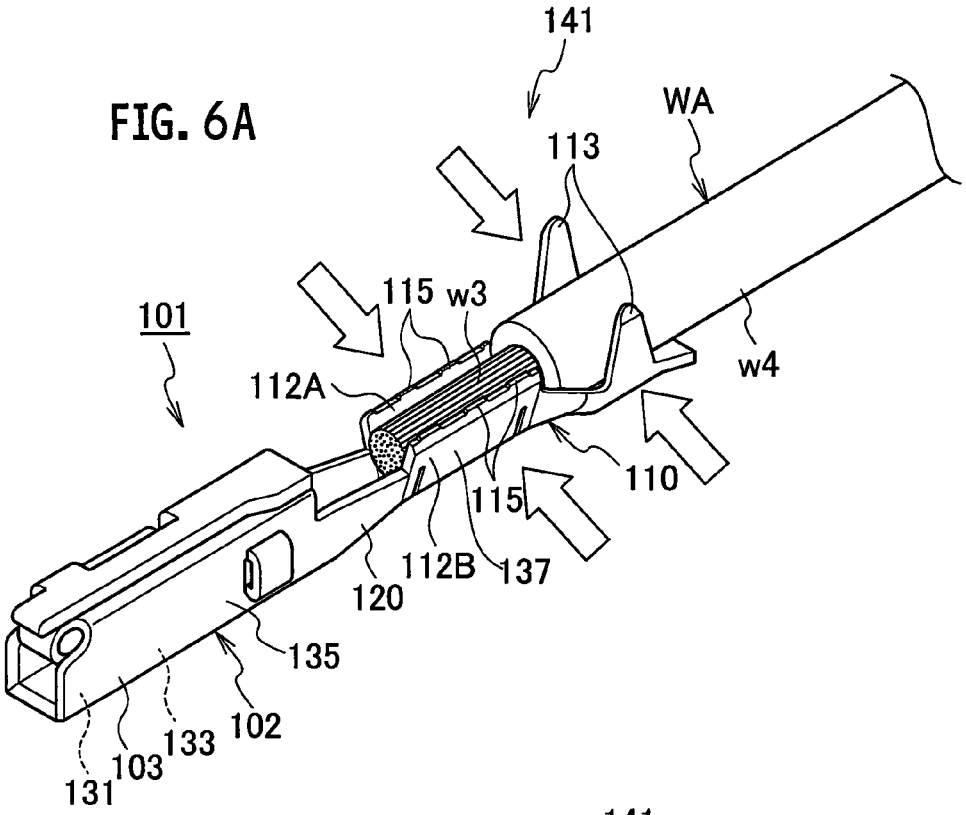
FIG. 6A is a perspective view of a crimping terminal according to a second embodiment of the present invention, before crimping a wire.
Figure 6B:
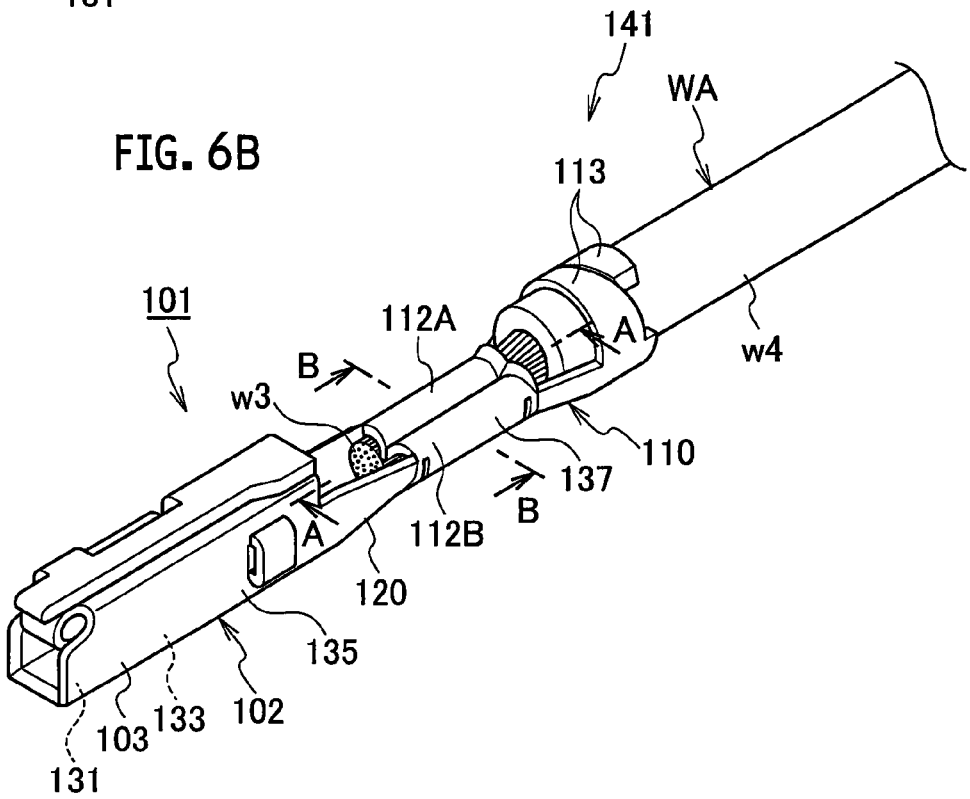
FIG. 6B is a perspective view of the crimping terminal according to a second embodiment of the present invention, after crimping a wire.

In addition, a base material 31 (see FIG. 5) provided with a first layer 33 and a second layer 35 on the surface, made of conductive metal material, is punched into a predetermined shape by press working, and the conductive metal material of the predetermined shape is bent, whereby the minute current crimping terminal 1 is formed (see FIGS. 1 and 2). The first layer 33 includes a material which removes the passive film present on the surface of the base material 31, and the second layer 35 includes a material which can increase the corrosion resistance and lubricity, and stabilizes the value of the electrical resistance. It should be noted that the display of the first layer 33 and second layer 35 in FIG. 4 are omitted so as to avoid the figure becoming unclear.

The base material 31 includes iron or iron alloy having corrosion resistance (such as stainless steel). In more detail, the base material 31 has the shape of the minute current crimping terminal 1 by plastic working (such as punching, bending and press working, except cutting) being performed on a flat plate material. The first layer 33 and second layer 35 are provided before the plastic working being applied to the base material 31.

The minute current crimping terminal 1 includes, as shown in FIGS. 1, 2, and the like, a mating terminal connecting portion 2 configured to make a connection with the minute current mating terminal (not shown), a wire crimping portion 10 configured to be crimped to the wire W, and a connecting portion 20 configured to connect between the mating terminal connecting portion 2 and the wire crimping portion 10.

The mating terminal connecting portion 2 has a female terminal shape, and includes a box portion (cylindrical portion) 3 of quadrangular frame shape, and an elastic spring contact portion 21 arranged in the box portion 3. The male terminal (not shown) being a minute current mating terminal is inserted into the box portion 3, and the inserted male terminal is configured to come into contact with the elastic spring contact portion 21 by the spring force.

The wire crimping portion 10 includes a wire barrel portion (core wire crimping portion; conductor connecting portion) 37 and an insulation barrel portion (jacket crimping portion) 39. The wire barrel portion 37 is configured to be connected to the core wire w1 of the wire W by the wire barrel portion 37 being crimped. The insulation barrel portion 39 is configured to hold a jacket w2 of the wire W by the insulation barrel portion 39 being crimped.

The first layer 33 includes nickel, and is, for example, provided on the base material 31 in a manner to cover the base material 31 by plating. The second layer 35 includes tin, and is, for example, provided on the first layer 33 (base material 31) in a manner to cover the first layer 33 by plating (see FIG. 5).

The thickness of the first layer 33 (nickel layer) is within the range of 0.2 μm to 3 μm, and the thickness of the second layer 35 (tin layer) is within the range of 0.8 μm to 3 μm.

In minute current crimping terminal 1 according to the first embodiment, the first layer 33 and the second layer 35 are provided on the entire surface of the base material 31. The first layer 33 and the second layer 35 may be provided on the base material 31, at least in a manner to cover the surface of a part of the base material 31 constituting the wire barrel portion 37. Furthermore, when the core wire w1 is connected, the first layer 33 and the second layer 35 may be provided only on a part in contact with core wire w1.

In addition, the second layer 35 may include silver or gold instead of tin.

The core wire w1 connected to wire barrel portion 37 has a cross section of 0.13 $mm^2$ to 0.5 $mm^2$. In more detail, the core wire w1 includes a set of a plurality of (for example, 8 to 12) elongated cylindrical strands, and total area of the cross section (cross section by a plane perpendicular to the longitudinal direction) of all the plurality of strands is 0.13 $mm^2$ to 0.5 $mm^2$.

In addition, the value of the current flowing through the wire w1 to be connected to the wire barrel portion 37 is 3.5 ampere or less (greater than 0 ampere, and 3.5 ampere or less). It should be noted that the value of the current flowing through the minute current wire harness WH is also 3.5 ampere or less.

Here, the method for manufacturing the minute current crimping terminal 1 will be described.

First, the first layer 33 made of a material to remove the passive film present on the surface of the base material 31 is provided on the surface of the base material 31 (for example, flat plate base material) including iron or iron alloy with corrosion resistance (first layer installation process).

Then, the second layer 35 including a material which can increase the corrosion resistance and lubricity, and stabilizes the value of the electrical resistance is provided on the surface of the first layer 33 provided in the first layer installation process (second layer installation process).

Then, the base material 31 provided with the first layer 33 and the second layer 35 respectively in the first layer installation process and the second layer installation process is formed (forming process).

The minute current crimping terminal 1 has a simple configuration, is hard to corrode even by many years of use, and makes it possible to reduce the temperature increase and the increase in electrical resistance due to the temperature increase by a minute current flowing therethrough, even when the base material contains stainless steel having larger electric resistance value as compared to copper.

According to the minute current crimping terminal 1, the base material 31 including stainless steel is covered with nickel layer and tin layer, and therefore, even when the core wire w1 including aluminum or aluminum alloy is connected, the potential difference between the minute current crimping terminal 1 and the wire W (core wire w1) is small, the elution of tin from the minute current crimping terminal 1 and the elution of aluminum from the core wire w1 are almost eliminated, and the minute current crimping terminal 1 and the wire W become hard to corrode even by many years of use. In addition, a conductive member such as the terminal in JP 2013-243106 A is not present, and therefore, the configuration is simplified.

In addition, in the minute current crimping terminal 1, even when the base material 31 contains stainless steel having larger electric resistance value as compared to copper, only a minute current is flowed, and therefore, defects such as the temperature increase and the increase in electrical resistance due to the temperature increase are not expected to occur.

In addition, according to the minute current crimping terminal 1, the first layer 33 includes nickel, and therefore, by removing the passive film having large electrical resistance having been present on the surface of the base material 31 including stainless steel, the first layer 33 can be provided on the base material 31.

By the way, the base material 31 is formed by the flat plate material being formed as mentioned above, and the first layer 33 and the second layer 35 are provided before the base material 31 is formed.

In more detail, after a predetermined flat plate shaped material is formed by the punching being performed on a flat plate material on which the first layer 33 and the second layer 35 are not provided, the first layer 33 and the second layer 35 are provided on the entire surface of the predetermined flat plate shaped material, then the bending, the press working, and the like are performed on the material on which the first layer 33 and the second layer 35 are provided, whereby the minute current crimping terminal 1 is formed.

The nickel layer 33 and the tin layer 35 are provided before the base material 31 is formed (flat plate material), whereby the nickel layer 33 and the tin layer 35 have uniform thicknesses to stabilize the quality, and it becomes easier to manufacture the minute current crimping terminal 1.

It should be noted that after a predetermined flat plate shaped material is formed by the punching being performed on a flat plate material on which the first layer 33 and the second layer 35 are previously provided on both surfaces in the thickness direction, the bending, the press working, and the like are performed on the predetermined flat plate shaped material, whereby the minute current crimping terminal 1 may be formed.

In addition, the first layer 33 and the second layer 35 may be provided after the forming. That is, after a predetermined flat plate shaped material is formed by the punching being performed on a flat plate material on which the first layer 33 and the second layer 35 are not provided, the bending, the press working, and the like are performed on the predetermined flat plate shaped material, the first layer 33 and the second layer 35 are provided on the entire surface of the material on which the bending, the press working, and the like are performed, whereby the minute current crimping terminal 1 may be formed.

Second Embodiment

A crimping terminal 101 according to a second embodiment, the crimping terminal 101 includes: a wire barrel portion 137 to which a core wire w3 including aluminum or aluminum alloy is connected; a material containing iron or iron alloy with corrosion resistance as base material 131; at least a first layer 133 provided on a surface of a part of the base material 131 constituting the wire barrel portion 137; and at least a second layer 135 provided on a surface of the first layer 133, wherein the first layer 133 includes a material to remove a passive film present on a surface of the base material 131, the second layer 135 includes a material capable of increasing corrosion resistance and lubricity, and stabilizing a value of electrical resistance, the wire barrel portion 137 is configured to include a bottom surface portion 111 and a pair of conductor crimping portions 112A and 112B extending laterally from both sides of the bottom surface portion 111, and recesses 114 are provided on at least one conductor arrangement surface of the bottom surface portion 111 and the conductor crimp portions 112A and 112B.

According to the crimping terminal 101 of the second embodiment described above, it is possible to provide the crimping terminal 101 that has simple configuration, reduces the increase in electrical resistance, and is hard to corrode even by many years of use. It is also possible to provide a wire harness 141 having the crimping terminal 101 and an electric wire WA with core wire w3. The core wire w3 includes aluminum or aluminum alloy and is connected to the wire barrel portion 137 of the crimping terminal 101.

In more detail, the crimping terminal 101 according to the second embodiment is configured as follows.

The Crimping terminal 101 according to the second embodiment is, as shown in FIGS. 6A to 6B, 7A to 7C, to be used by being connected to a wire WA, and a core wire (conductor) w3 of the wire WA includes, for example, aluminum or aluminum alloy. The wire WA where the crimping terminal 101 is installed (connected) becomes a wire harness (for example, a wire harness for a car) 141.

Figure 8:
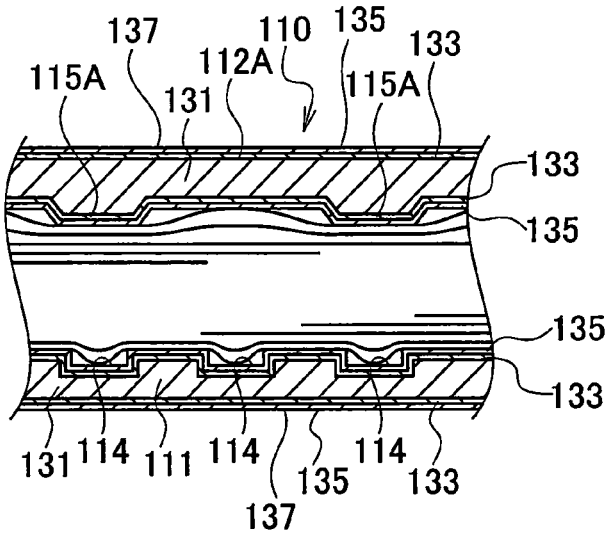
FIG. 8 shows a crimping terminal according to the second embodiment of the present invention, and is a sectional view taken along the line A-A in FIG. 6B.
Figure 9:
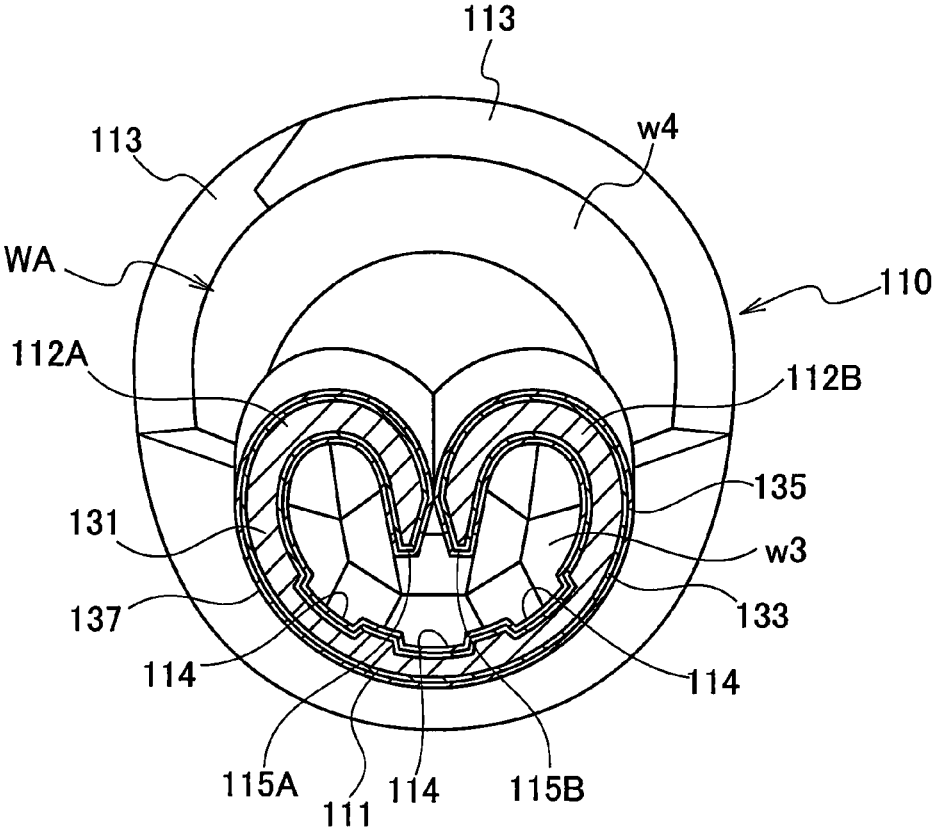
FIG. 9 shows a crimping terminal according to the second embodiment of the present invention, and is a sectional view taken along the line B-B in FIG. 6B.
Figure 10:
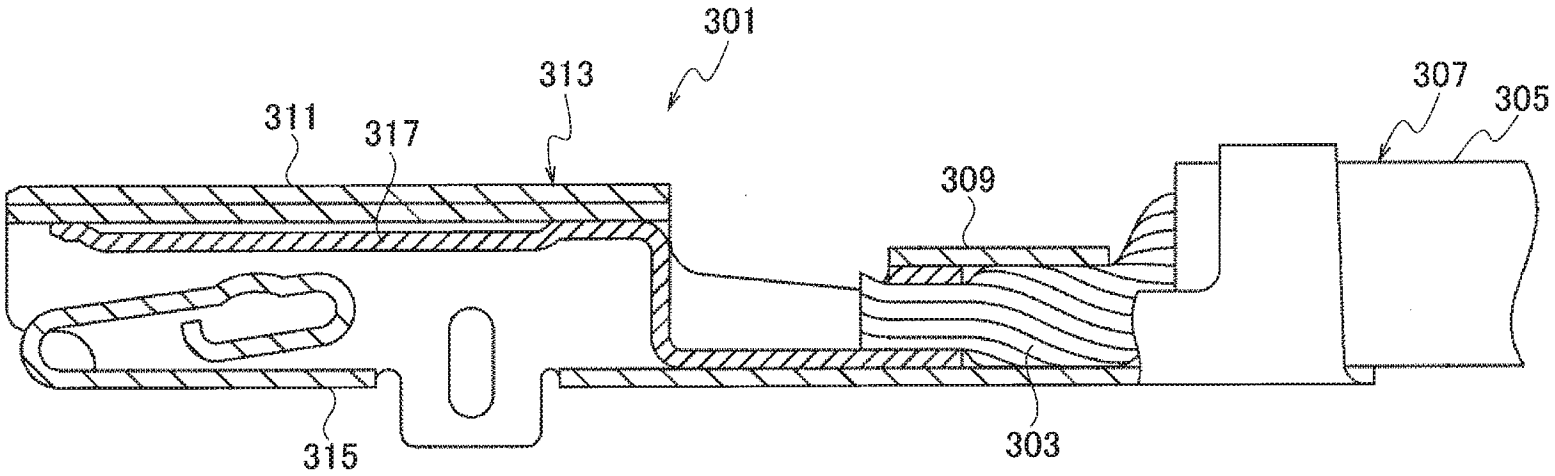
FIG. 10 PRIOR ART
FIG. 10 is a diagram showing a conventional crimping terminal.

In addition, as shown in FIGS. 8 and 9, a base material 131 of conductive metal material on the surface of which the first layer 133 and the second layer 135 are provided is punched into a predetermined shape by press working, and the bending is performed on the conductive metal material of the predetermined shape, whereby the crimping terminal 101 is formed.

The base material 131 includes iron or iron alloy with corrosion resistance (such as stainless steel). It should be noted that as a matter of course, predetermined processing such as the bending described above is performed, whereby base material 131 has a shape of the crimping terminal 101.

In addition, the crimping terminal 101 includes a mating terminal connecting portion 102 configured to connect with the mating terminal (not shown), a wire crimping portion 110 configured to be crimped onto the wire WA, and a connecting portion 120 configured to connect between the mating terminal connecting portion 102 and the wire crimping portion 110.

The mating terminal connecting portion 102 has a female terminal shape, and includes a box portion 103 of quadrangular frame shape, and an elastic spring contact portion (not shown) arranged in the box portion 103. A male terminal (not shown) being a mating terminal is inserted into box portion 103, and the inserted male terminal is configured to come into contact with the elastic spring contact portion by the spring force.

The wire crimping portion 110 includes an U-shaped bottom surface portion 111 extending from the connecting portion 120, a pair of conductor crimping portions 112A and 112B each of which is projecting from the corresponding side of bottom surface portion 111, and a pair of jacket crimping portions (insulation barrel portions) 113. It should be noted that the wire barrel portion (conductor connecting portion) 137 where core wire w3 is connected is formed by the pair of conductor crimping portions 112A and 112B and the bottom surface portion 111.

The first layer 133 includes nickel, and is, for example, provided on the base material 131 in a manner to cover the base material 131 by plating. The second layer 135 includes tin, and is, for example, provided on the first layer 133 (base material 131) in a manner to cover the first layer 133 by plating.

The thickness of the first layer 133 (nickel layer) is within the range of 0.2 to 3 μm, and the thickness of the second layer 135 (tin layer) is within the range of 0.8 μm to 3 μm.

In minute current crimping terminal 101 according to the second embodiment, the first layer 133 and the second layer 135 are provided on the entire surface of the base material 131. The first layer 133 and the second layer 135 may be provided on the base material 131, at least in a manner to cover the surface of a part of the base material 131 constituting the wire barrel portion 137. Furthermore, when the core wire w3 is connected, the first layer 133 and the second layer 135 may be provided only on a part in contact with core wire w3.

In addition, the second layer 135 may include silver or gold instead of tin.

Figure 7A:
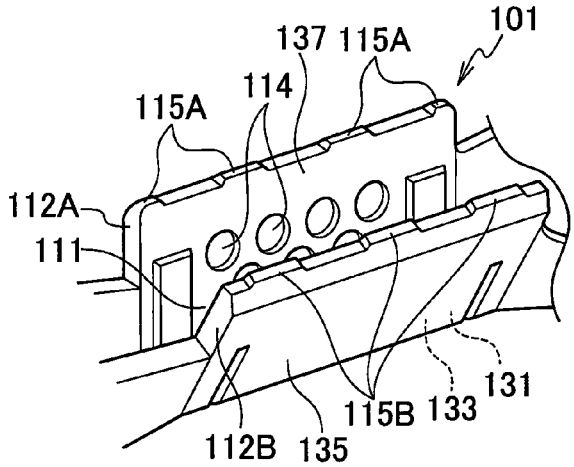
FIG. 7A shows a crimping terminal according to the second embodiment of the present invention, and is a perspective view of a conductor crimping portion.
Figure 7B:
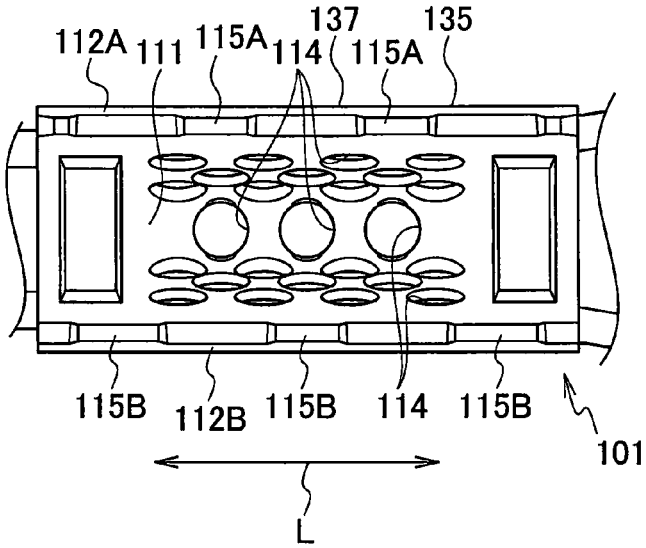
FIG. 7B shows a crimping terminal according to the second embodiment of the present invention, and is a plan view of the conductor crimping portion.
Figure 7C:
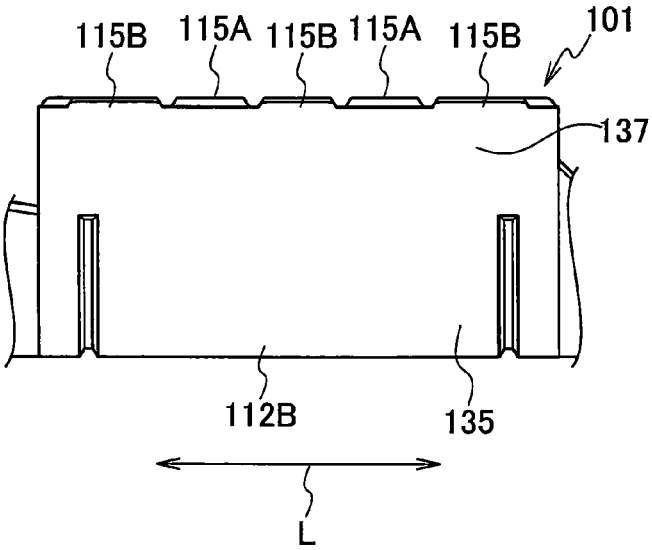
FIG. 7C shows a crimping terminal according to the second embodiment of the present invention, and is a side view of the conductor crimping portion.

By the way, as shown in FIGS. 7A to 7C, a large number of small circular recesses (serrations) 114 are provided in dotted form on the wire arrangement surfaces (inner surfaces) of both the bottom surface portion 111 and each of the conductor crimping portions 112A and 112B. A plurality of projections 115A and 115B are provided on the tip end surface of each of conductor crimping portions 112A and 112B. The plurality of projections 115A and 115B are respectively provided at intervals on the two tip end surfaces of the pair of conductor crimping portions 112A and 112B. Projections 115A of one conductor crimping portion 112A and projections 115B of the other conductor crimping portion 112B are alternately arranged in mutually different positions of the pair of conductor crimping portions 112A and 112B with respect to the axial direction L of the wire WA.

The conductor w3 of the wire WA placed on the bottom surface portion 111 of the wire crimping portion 110 is crimped by the crimping deformation of the pair of conductor crimping portions 112A and 112B, and a jacket position w4 of the wire WA placed on the bottom surface portion 111 is crimped by the crimping deformation of the pair of jacket crimping portions 113, whereby the crimping terminal 101 is crimped to the wire WA to be fixed.

In the crimping terminal 101, as shown in FIGS. 8 and 9, the conductor w3 bites into each recess 114. In addition, each of the projections 115A and 115B presses the upper surface side of the conductor w3 in a manner to bite into the upper surface. Thus, due to both the recess 114 and the projections 115A and 115B, improvement of fixing force to the conductor w3 (specifically, improvement of resisting force against the wire exit direction) can be achieved, and therefore, as compared to conventional crimping terminal, it is possible to further improve the conductor fixing force (tightening force).

The projections 115A and 115B are respectively provided in a plurality of positions at intervals on the two tip end surfaces of the pair of conductor crimping portions 112A and 112B, and are alternately arranged in mutually different positions of the pair of conductor crimping portions 112A and 112B. Thus, each of the projections 115A and 115B of the pair of conductor crimping portions 112A and 112B bites alternately in different positions on the upper surface side of the conductor w3, and therefore, as compared to the case of bites in the same position, improvement of the fixing force can be achieved. The projections 115A and 115B can be formed by the punching with the press from the base material 131 on which the first layer 133 and the second layer 135 are provided, and therefore, the forming is easier, and the degree of freedom of shape change is also higher.

The recesses 114 are provided on the conductor arrangement surfaces of the two of the bottom surface portion 111 and each of the conductor crimping portions 112A and 112B. Thus, as compared to the case where the recesses 114 are formed only on one of the bottom surface portion 111 and the conductor crimping portions 112A and 112B, improvement of the fixing force can be achieved. It should be noted that the recesses 114 may be provided only on any one of the bottom surface portion 111 and each of the conductor crimping portions 112A and 112B.

It should be noted that in the crimping terminal 101 described above, although the recess 114 has a small circular shape, the recessed shape may include a quadrangular shape and an elongated linear shape, and various shapes can be considered.

According to the crimping terminal 101, the base material 131 including stainless steel is covered with the nickel layer 133 and the tin layer 135, and therefore, even when the core wire w3 including aluminum or aluminum alloy is connected, the potential difference between the crimping terminal 101 and the wire WA (core wire w3) is small, the elution of tin from the crimping terminal 101 and the elution of aluminum from the core wire w3 are almost eliminated, and the crimping terminal 101 becomes hard to corrode even by many years of use. In addition, there is no conductive member such as the terminal in JP 2013-243106 A, and therefore, the configuration is simplified.

In addition, according to the crimping terminal 101, the wire barrel portion 137 is configured to include the bottom surface portion 111 and the pair of conductor crimping portions 112A and 112B extending laterally from both sides, the recesses 114 are provided on the conductor arrangement surfaces of the bottom surface portion 111 and the conductor crimping portions 112A and 112B, and the projections 115A and 115B are provided on the tip end surfaces of the conductor crimping portions 112A and 112B, and therefore, when the wire barrel portion 137 is connected to the core wire w3, the wire barrel portion 137 bites into core wire w3, and the adhesion area is increased. This makes it possible to ensure the contact portion resistance (electrical resistance between the crimping terminal 101 and the core wire w3) equivalent to the case where the base material 131 includes copper or copper alloy, and the fixing force.

In addition, according to the crimping terminal 101, the first layer 133 includes nickel, and therefore, by removing the passive film having large electrical resistance having been present on the surface of the base material 131 including stainless steel, the first layer 133 can be provided on the base material 131.

In addition, according to the crimping terminal 101, the second layer 135 includes tin, and therefore, the corrosion resistance and lubricity can be increased, and the value of the electrical resistance can be stabilized.

By the way, as described above, the base material 131 is formed by the forming (plastic working such as bending and pressing, except cutting) being performed on a flat plate material, and the first layer 133 and the second layer 135 are provided before the base material 131 is formed.

The method for manufacturing the crimping terminal 101 according to the second embodiment, the crimping terminal 101 includes: the wire barrel portion 137 to which the core wire w3 including aluminum or aluminum alloy is connected; and a material including iron or iron alloy with corrosion resistance as the base material 131, the method includes: a first layer installation step providing the first layer 133 on a surface of a flat plate material constituting the base material 131; a second layer installation step providing the second layer 135 on a surface of the first layer 133 provided in the first layer installation step; and a forming step forming the base material 131 on which the first layer 133 and the second layer 135 are provided in the first layer installation step and the second layer installation step, and wherein the first layer 133 includes a material to remove a passive film present on a surface of the base material, the second layer 135 includes a material capable of increasing corrosion resistance and lubricity, and stabilizing a value of electrical resistance, the wire barrel portion 137 is configured to include the bottom surface portion 111 and the pair of conductor crimping portions 112A and 112B extending laterally from both sides of bottom surface portion 111, and the recesses 114 are provided on at least one conductor arrangement surface of the bottom surface portion 111 and the conductor crimp portions 112A and 112B.

In more detail, the crimping terminal 101 is manufactured through the following processes.

After a predetermined flat plate shaped material is formed by the punching being performed on a flat plate material (material to be base material 131) on which the first layer 133 and the second layer 135 are not provided, the first layer 133 (for example, nickel layer) is provided, for example, on the entire surface of the predetermined flat plate shaped material (first layer installation process).

Subsequently, the second layer 135 (for example, tin layer) is provided, for example, on the entire surface of the first layer 133 provided in the first layer installation process (second layer installation process).

Subsequently, the crimping terminal 101 is formed by bending, press working, and the like being performed on the base material 131 (base material with each layer installed) provided with the first layer 133 and the second layer 135 in the first layer installation process and the second layer installation process (forming process).

Thus, the nickel layer 133 and the tin layer 135 are provided before the base material 131 is formed (flat plate material), whereby the nickel layer 133 and the tin layer 135 have uniform thicknesses to stabilize the quality, and it becomes easier to manufacture the minute current crimping terminal 101.

It should be noted that after a predetermined flat plate shaped material is formed by the punching being performed on a flat plate material on which the first layer 133 and the second layer 135 are previously provided on both surfaces in the thickness direction, the bending, the press working, and the like are performed on the predetermined flat plate shaped material, whereby the minute current crimping terminal 101 may be formed.

In addition, the first layer 133 and the second layer 135 may be provided after the forming. That is, after a predetermined flat plate shaped material is formed by the punching being performed on a flat plate material on which the first layer 133 and the second layer 135 are not provided, the bending, the press working, and the like are performed on the predetermined flat plate shaped material, the first layer 133 and the second layer 135 are provided on the entire surface of the material on which the bending, the press working, and the like are performed (the base material 131), whereby the minute current crimping terminal 101 may be formed.

In addition, it is a matter of course that the crimping terminal 101 can also be applied to a crimping terminal configured to caulk and crimp the waterproof component attached to the jacket w4 of the wire WA at the pair of jacket crimping portions 113, and to a joint terminal and the like configured to conduct between terminals.

In addition, the crimping terminal 101 is an example of a crimping terminal which includes: the wire barrel portion 137 to which the core wire w3 including aluminum or aluminum alloy is connected; a material containing iron or iron alloy with corrosion resistance as the base material 131; at least the first layer 133 provided on a surface of a part of the base material constituting the wire barrel portion; and at least the second layer 135 provided on a surface of the first layer, wherein the first layer includes a material to remove a passive film present on a surface of the base material, the second layer includes a material capable of increasing corrosion resistance and lubricity, and stabilizing a value of electrical resistance, the wire barrel portion is configured to include the bottom surface portion 111 and the pair of conductor crimping portions 112A and 112B extending laterally from both sides of the bottom surface portion 111, and the recesses 114 are provided on at least one conductor arrangement surface of the bottom surface portion and the conductor crimp portions.

What is claimed is:

1. A minute current crimping terminal comprising:

a wire barrel portion connected to a core wire including any one of aluminum and aluminum alloy, a current flowing through the core wire being lower than a normal current; and a mating terminal connecting portion formed in rectangular cylindrical shape and having an elastic spring contact portion disposed on the inner side of the mating terminal connecting portion, the wire barrel portion comprising:

a base material including any one of iron and iron alloy with corrosion resistance;

at least a first layer provided directly on a surface of a part of the base material configuring the wire barrel portion; and at least a second layer provided directly on a surface of the first layer, wherein the first layer and the second layer are provided only on a part of the wire barrel portion in contact with the core wire, the first layer includes a material to remove a passive film present on a surface of the base material, and the second layer includes a material capable of increasing corrosion resistance and lubricity, and stabilizing a value of electrical resistance.

2. The minute current crimping terminal according to claim 1, wherein the first layer includes nickel, and the second layer includes any one of tin, silver, and gold.

3. The minute current crimping terminal according to claim 1, wherein the core wire connected to the wire barrel portion has a cross section of 0.13 square millimeters to 0.5 square millimeters, and a value of the current flowing through the core wire connected to the wire barrel portion is 3.5 ampere or less.

4. A minute current wire harness comprising:

the minute current crimping terminal according to claim 1; and a wire including the core wire connected to the wire barrel portion.

5. The minute current wire harness according to claim 4, wherein the minute current wire harness is coupled to a minute current circuit.

6. The minute current wire harness according to claim 5, wherein the minute current wire harness enables transmission of a low current electrical signal in a vehicle.

7. The minute current crimping terminal according to claim 1, wherein the base material including the first layer and the second layer comprises a shape of the minute current crimping terminal by plastic working.

8. The minute current crimping terminal according to claim 7, wherein the plastic working comprises one of: punching, bending and press working performed on a flat plate material.

9. The minute current crimping terminal according to claim 7, wherein the first layer and the second layer are provided before the plastic working of the base material.

10. The minute current crimping terminal according to claim 1, wherein a thickness of the first layer is within a range of 0.2 μm to 3 μm and a thickness of the second layer is within a range of 0.8 μm to 3 μm.

11. The minute current crimping terminal according to claim 1, wherein the core wire includes a set of a plurality of elongated cylindrical strands, and a total area of a cross section of all the plurality of elongated cylindrical strands is 0.13 $mm^2$ to 0.5 $mm^2$.

12. The minute current crimping terminal according to claim 1, wherein the minute current crimping terminal further includes a joining part connecting the mating terminal connecting portion and the wire barrel portion.

13. The minute current crimping terminal according to claim 1, wherein the minute current crimping terminal further includes an insulation barrel portion configured to crimp an insulating layer covering the core wire.

14. A method for manufacturing a minute current crimping terminal, the minute current crimping terminal comprising:

a wire barrel portion connected to a core wire including any one of aluminum and aluminum alloy, a current flowing through the core wire being lower than a normal current; and a mating terminal connecting portion formed in rectangular cylindrical shape and having an elastic spring contact portion disposed on the inner side of the mating terminal connecting portion, the method comprising:

forming a base material;

providing a first layer including a material to remove a passive film present on a surface of the base material, directly on the surface of the base material of the wire barrel portion including any one of iron and iron alloy and to provide the surface of the base material with corrosion resistance; and providing a second layer including a material capable of increasing corrosion resistance and lubricity, and stabilizing a value of electrical resistance directly on a surface of the provided first layer, wherein the first layer and the second layer are provided only on a part of the wire barrel portion in contact with the core wire.

15. The method for manufacturing a minute current crimping terminal according to claim 14, wherein forming the base material on which the first layer and the second layer are provided comprises forming the base material on which the first layer and the second layer are provided into a shape of the minute current crimping terminal by plastic working.

16. The method for manufacturing a minute current crimping terminal according to claim 15, wherein the plastic working comprises one of: punching, bending and press working performed on a flat plate material.

17. The method for manufacturing a minute current crimping terminal according to claim 15, wherein the first layer and the second layer are provided before the plastic working of the base material.

18. The method for manufacturing a minute current crimping terminal according to claim 14, wherein a thickness of the first layer is within a range of 0.2 μm to 3 μm and a thickness of the second layer is within a range of 0.8 μm to 3 μm.

19. The method for manufacturing a minute current crimping terminal according to claim 14, wherein the core wire connected to wire barrel portion has a cross section of 0.13 $mm^2$ to 0.5 $mm^2$.

20. The method for manufacturing a minute current crimping terminal according to claim 19, wherein the core wire includes a set of a plurality of elongated cylindrical strands, and a total area of a cross section of all the plurality of elongated cylindrical strands is 0.13 $mm^2$ to 0.5 $mm^2$.

* * * * *